US005813538A

United States Patent [19]

Kaufman

[11] Patent Number: 5,813,538

[45] Date of Patent: Sep. 29, 1998

[54] PROMOTIONAL PACKAGE

[75] Inventor: Mark S. Kaufman, Stamford, Conn.

[73] Assignee: 3-Strikes Custom Design, Stamford, Conn.

[21] Appl. No.: 713,608

[22] Filed: Sep. 13, 1996

Related U.S. Application Data

[63] Continuation-in-part of Ser. No. 567,951, Dec. 6, 1995, abandoned, which is a continuation of Ser. No. 246,968, May 20, 1994, abandoned.

[51] Int. Cl.[6] ..... B65D 73/00

[52] U.S. Cl. ..... 206/457; 206/278; 206/292; 206/281

[58] Field of Search ..... 206/216, 225, 206/232, 278, 281, 292, 457, 497, 524.8, 769, 770, 812

[56] References Cited

U.S. PATENT DOCUMENTS

| | | | |
|---|---|---|---|
| 3,099,568 | 7/1963 | Brody et al. . | |
| 3,195,265 | 7/1965 | Marquez et al. | 206/457 |
| 3,354,576 | 11/1967 | Gralnick . | |
| 4,205,750 | 6/1980 | Dews | 206/497 |
| 4,374,563 | 2/1983 | Alexander | 206/497 |
| 4,475,651 | 10/1984 | Elsner | 206/497 |
| 4,573,571 | 3/1986 | Leem . | |
| 4,593,817 | 6/1986 | Ferrero | 206/457 |
| 4,802,577 | 2/1989 | O'Leary | 206/278 |
| 4,883,187 | 11/1989 | Knitzer . | |
| 4,903,843 | 2/1990 | Fischer | 206/497 |
| 4,921,094 | 5/1990 | van den Akker . | |
| 4,928,831 | 5/1990 | Kirsch . | |
| 5,042,227 | 8/1991 | Merry | 206/524.8 |
| 5,069,645 | 12/1991 | Dworman et al. | 206/457 |
| 5,117,976 | 6/1992 | Whitt et al. | 206/497 |
| 5,265,727 | 11/1993 | Anderson . | |
| 5,368,953 | 11/1994 | Zaborney et al. | 206/497 |
| 5,485,919 | 1/1996 | Samberg et al. | 206/278 |
| 5,489,126 | 2/1996 | Gray, Jr. | 206/497 |
| 5,503,274 | 4/1996 | Toffler et al. . | |

*Primary Examiner*—David T. Fidei
*Attorney, Agent, or Firm*—St. Onge Steward Johnston & Reens LLC

[57] ABSTRACT

A promotional package is disclosed which simulates a product package. The promotional package includes a fabric article compressed into a shape simulating a portion of the external contour of the product package. The fabric article is compressed sufficiently under substantially pressure such that it is dimensionally stable and self-supporting; as such, it provides substantially all of the shape of the promotional package at the position of the compressed fabric article. At least one decorative unit having a shape simulating another portion of the product package is located adjacent to the compressed fabric article. A flexible retainer maintains the compressed fabric article adjacent to the decorative unit so as to form a combined shape simulating the external contour of the product package.

14 Claims, 3 Drawing Sheets

PROMOTIONAL PACKAGE

CROSS-REFERENCE TO RELATED APPLICATION

This application is a continuation-in-part of application Ser. No. 08/567,951 filed on Dec. 6, 1995 for "A Promotional Package Including a Compressed Fabric Article That Simulates a Product Package," which has been abandoned and is itself a continuation of application Ser. No. 08/246,968, filed on May 20, 1994, for "A Promotional Package Including A Compressed Fabric Article That Simulates A Product Package," now abandoned.

BACKGROUND OF THE INVENTION

1. Field of the Invention

The present invention relates to the promotion of various products by printing promotional information on t-shirts, towels, and other fabric articles, and packaging such t-shirts in a form that simulates the actual product that is being promoted. More specifically, the present invention relates to a promotional package that includes a compressed fabric article such as a t-shirt, towel and the like and wherein the promotional package simulates the actual product.

2. Description of the Prior Art

Products are often promoted by printing promotional information on fabric articles such as t-shirts, towels, hats and the like, and distributing such articles for promotional purposes. The person utilizing or wearing the article promotes the underlying product through exhibition of the product. The fabric article is often folded and packaged in a plastic bag with at least a portion of the promotional materials visible from the outside of the plastic bag and distributed.

Packages simulating a particular shape for housing loosely, non-compressed fabric articles are also known. For example, U.S. Pat. No. 3,354,576 to E. Gralnick discloses a toy rocket for packaging and storing night clothes. The package is of a tubular configuration and is of sufficient internal dimension to accommodate a pair of pajamas in a lightly compressed and optimally rolled state. Col. 2, lines 45–50. The rocket packaging is of sufficient structural integrity that, after purchasing the toy, a child may convert the package into a toy simulating a space rocket and may break-down and reassemble the rocket as often as desired.

One drawback of the Gralnick patent is that the rocket provides all of the dimensional stability of the device, and the fabric article is not dimensionally stable. The rocket-shaped housing provides all of the shape for the fabric article such that the fabric article takes on the shape of the rocket, not vice versa. Only the rocket packaging is self-supporting, the fabric article is not.

Additionally, it is known to have flexible packaging to surround an object which is self-supporting, i.e., dimensionally stable. For example, U.S. Pat. No. 5,265,727 to Anderson discloses a dimensionally stable gift item, such as a bottle of champagne, which is then at least partially enclosed by shrink wrap. Anderson fails to disclose the use of shrink-wrap with compressed fabric articles.

It is known to package fabric articles through use of compression technology. More specifically, the fabric article, such as a t-shirt, is compressed in a mold under substantial pressures into a shape such as a cylinder or rectangle. The compressed fabric article can then be shrink wrapped in plastic and distributed. The compression of the fabric article is useful as an aide to induce the potential user of the article to show interest in the compressed fabric article. Additionally, the storage space for the article is substantially reduced, and the packaging for the compressed article is simplified.

One drawback of the compressed fabric article is the limitation on the shape of the compressed article. Since the article is compressed under large pressure in a mold, simple shapes such as cylindrical and rectangular are available, but at present it is not known to compress an article into a complex shape that has curves and irregular surfaces. Another drawback resides in the lack of promotional appeal that these compressed fabric articles have. They are distributed as is, and are not packaged in a shape simulating the product desired to be advertised.

SUMMARY OF INVENTION

Thus, it is an object of the invention to provide a promotional package that includes a compressed fabric article that simulates the product packaging.

It is another object of the present invention to provide a promotional package that includes a compressed fabric article, wherein the compressed fabric article is formed under substantial pressure.

It is still another object of the present invention to provide a promotional package that includes a compressed fabric article, wherein the compressed fabric article is formed under substantial pressure such that it is dimensionally stable, i.e. self-supporting.

It is still a further object of the invention to provide a promotional product that is simple to manufacture and does not require a large number of parts.

In accordance with the present invention, a promotional package is provided that simulates the actual product package. More specifically, in accordance with the present invention, if one desires to promote a beverage that comes in a bottle that has a generally cylindrical portion, with a shoulder and then a narrow bottled neck, it is possible to produce a promotional package that simulates such bottle. The actual product may have a label bearing a brand on the front of the bottle, and may have a distinctive appearance that is known in the industry.

In accordance with the present invention, the promotional package includes a fabric article compressed under substantial pressure into a shape simulating a portion of the external contour of the product package. In the case of a bottle, the fabric article is compressed into a cylindrical shape that simulates the shape of the bottom portion of the actual bottle. In a preferred embodiment of the invention, the fabric article prior to compression is printed with promotional information such as the beverage label or a slogan that is used in advertising to promote the beverage.

At least one decorative unit having a shape simulating another portion of the external contour of the product package is provided and is located adjacent the compressed fabric article. In the case of a promotional package simulating a bottle, the decorative unit can be molded from plastic and have a shape simulating the shoulder and neck of the bottle. A retainer for maintaining the compressed fabric article adjacent to the decorative unit is provided and the two parts, i.e., the compressed fabric article and the decorative unit, form a combined shape simulating the external contour of the product package.

In accordance with one aspect of the invention, a label, such as a paper label is printed to simulate the labelling on the actual product package. The rectangular label is affixed to the simulated product package in a manner and location so as to resemble the actual product package. In one preferred embodiment, the label is wrapped around at least a portion of the cylindrical surface of the compressed fabric article.

In accordance with one aspect of the invention, the retainer comprises a sheet of transparent material that is shrink wrapped around at least a portion of the fabric article, the decorative unit and the label to form a combined shape simulating the exterior contour and appearance of the product package. Thus, the promotional package standing alone is quite reminiscent of the actual product package, and in some cases, when the imitation is done to scale, the promotional product is thought to be the actual product package until the potential user closely examines the package.

In the case where a manufacturer wants to promote a distinctive bottle or packaging image, the present invention provides an excellent vehicle to remind customers and potential customers of the visual appearance of the packaging. More particularly, in the case of a liquor marketed under the ABSOLUTE brand, the bottle has a distinctive shape that is advertised heavily. It would be useful to be able to provide a prepackaged compressed article, such as a t-shirt or a towel, bearing the promotional material to promote the ABSOLUTE liquor, and have the t-shirt, for example, packaged in a manner that appears as a miniature model bearing the ABSOLUTE brand. In this way, not only is the brand itself promoted, but the distinctive appearance of the bottle shape is also promoted and impressed in the mind of the potential customer.

Other objects and advantages of a product package in accordance with the present invention will be apparent from the detailed description of the invention with reference to the drawings which follows.

DETAILED DESCRIPTION OF THE INVENTION

Figure 1:
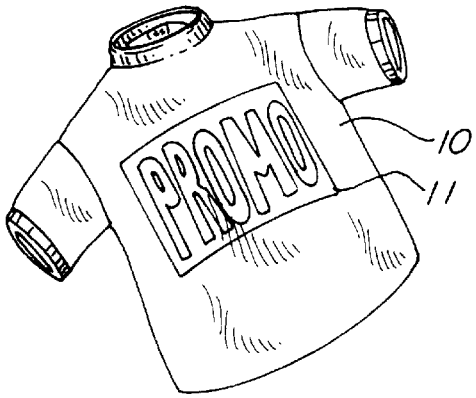
FIG. 1 s a perspective view of a t-shirt bearing promotional information.
Figure 2:
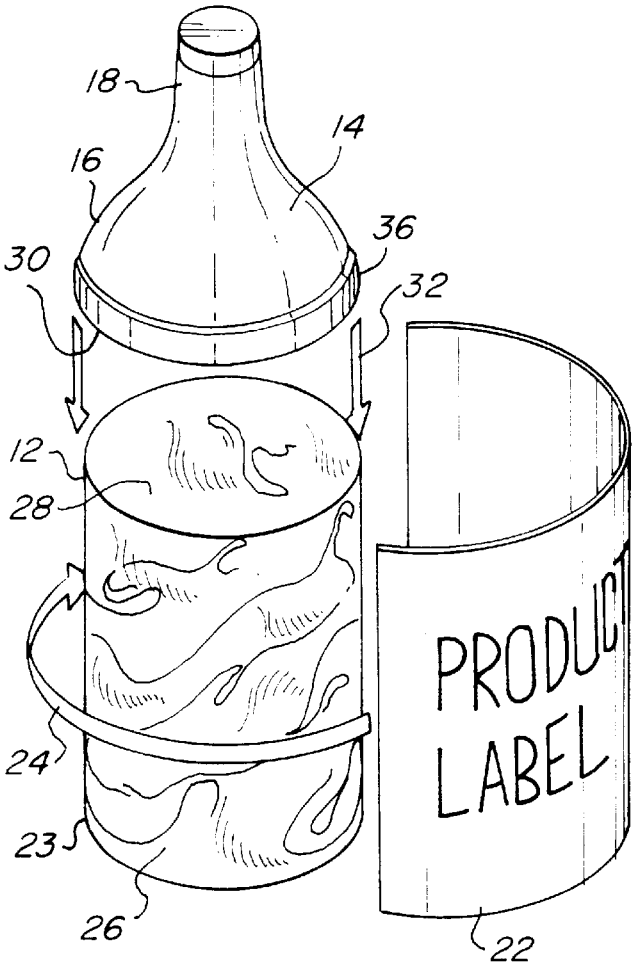
FIG. 2 is a perspective, exploded view of a promotional package simulating a bottle, constructed in accordance with the present invention, and comprising the t-shirt of FIG. 1 in compressed form.

Referring to FIG. 1, a t-shirt 10 bearing a promotional message 11 is compressed into a cylindrical shape as shown in FIG. 2 to simulate a product package. Although a t-shirt is shown by way of example, any number of compressible fabric articles may be used including towels, hats, boxer shorts, aprons, smocks, socks, underwear and visors. Although t-shirts have been shown and are discussed herein, they are referenced for convenience only; the disclosure is not intended to be limited to them.

The basic compression technology as applied to fabric articles is well-known in the art. Generally, the fabric article to be compressed is placed in a mold, and a piston under substantial pressure compresses the fabric article into the shape of a cylinder, rectangle or whatever shape the mold is designed to produce. In the case of the simulated promotional package shown in FIG. 2, the mold produces a compressed fabric article 12 having a generally cylindrical shape.

Advantageously, the fabric article 12 is compressed under substantial pressure such that it is self-supporting. That is, it is compressed sufficiently so that it is dimensionally stable and is therefore able to provide substantially all of the structural integrity necessary to maintain the promotional package in the desired shape.

At least one decorative unit 14 is provided and has a shape that simulates another portion of the product package. In the case of the bottle shown in FIG. 2, the decorative unit has a complex curved shape that simulates the shoulder 16 and neck 18 of a bottle. The decorative unit shown in FIG. 2 is formed of molded plastic and is hollow. However, the decorative unit 14 could be formed of any number of materials, and could be solid and/or partially filled. In some cases, the decorative unit 14 could also accomplish an additional purpose. For example, the decorative unit 14 could be a hollow chocolate figure, or it could be a hollow plastic body filled with pieces of candy or other objects.

Figure 3:
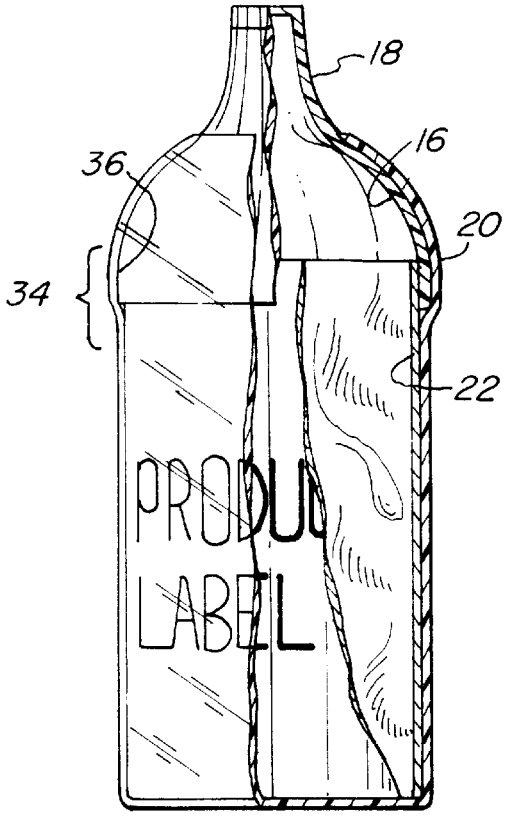
FIG. 3 is an assembled view of the promotional package shown in FIG. 2.

As shown in FIGS. 2 and 3, the compressed fabric article 12 is placed adjacent the decorative unit 14. As shown in FIG. 3, a retainer 20, which overlies at least a portion of the compressed fabric article 12 and at least a portion of the decorative unit 14, maintains the compressed fabric article 12, and the decorative unit 14 in the assembled position. Most preferably, retainer 20 overlies at least a portion of decorative unit 14 and substantially all of compressed fabric article 12. It should be understood that retainer 20 could, if desired, completely envelope decorative unit 14 and compressed fabric article 12.

Retainer 20 maintains the position of the decorative unit 14 relative to, i.e., adjacent to the compressed fabric article 12, and, when in the orientation shown in FIGS. 2–3, the retainer maintains the decorative unit 14 on the top of fabric unit 12.

Retainer 20 is flexible. Thus it is neither dimensionally stable nor self-supporting, unlike the compressed fabric article 12.

Because retainer 20 is flexible, it takes on the shape of the portion of the decorative unit 14 and the compressed fabric article 12 with which it comes into contact. Accordingly, compressed fabric article 12 provides substantially all of the shape of the simulated product package at the position of the compressed fabric article 12, i.e., the bottom portion 23, and decorative unit 14 provides substantially all of the shape of the simulated product package at the position of the decorative unit 14.

In accordance with a preferred aspect of the invention, the simulated promotional package further includes a label 22 which bears printing simulating the label on the actual product. In the case where a bottle is simulated, the label 22 will bear printing that simulates the actual label that is on the bottle of the beverage. The label 22 is wrapped around the compressed fabric article 12 as shown by arrow 24. The label can be either completely wrapped, and/or partially wrapped around the compressed fabric article 12 so that it is positioned closely adjacent the surface of the compressed fabric article 12.

The retainer 20 is preferably a sheet of transparent polymeric material, and more specifically, through known heat shrinking techniques, the plastic sheet 20 can be wrapped around the combined decorative unit 14, label 22 and compressed fabric article 12 so that the printing on the label 22 is visible and the parts of the promotional package are combined to form a shape simulating the external contour and appearance of the actual product package.

In accordance with one aspect of the invention, the compressed fabric article comprises a body having a continuous sidewall 26 terminating in planar end portion 28. The decorative unit has an end 30 that is placed in face-to-face relation with the planar end portion 28 as shown by arrows 32. The sidewall 36 of the decorative unit is sized to provide a smooth transition 34 as shown in FIG. 3 between the sidewall 36 of the decorative unit 14 and the sidewall 26 of the compressed fabric article 12.

In accordance with one aspect of the invention, the decorative unit 14 comprises a hollow body having an opening at one end thereof to form the end of the unit. The opening is slightly larger than the planar end portion 28 of the compressed fabric article 12 and the article is inserted through the opening partially into the hollow body. This is shown particularly well in the sectional portion of FIG. 3. Retainer 20 maintains the end 28 of the compressed fabric article 12 inside the opening of the decorative unit 14.

The continuous sidewall 26 of the compressed fabric article is preferably a simple shape, that is, its surface lies in a series of parallel lines. This relatively simple shape provides for molding and compression of the article.

Figure 4:
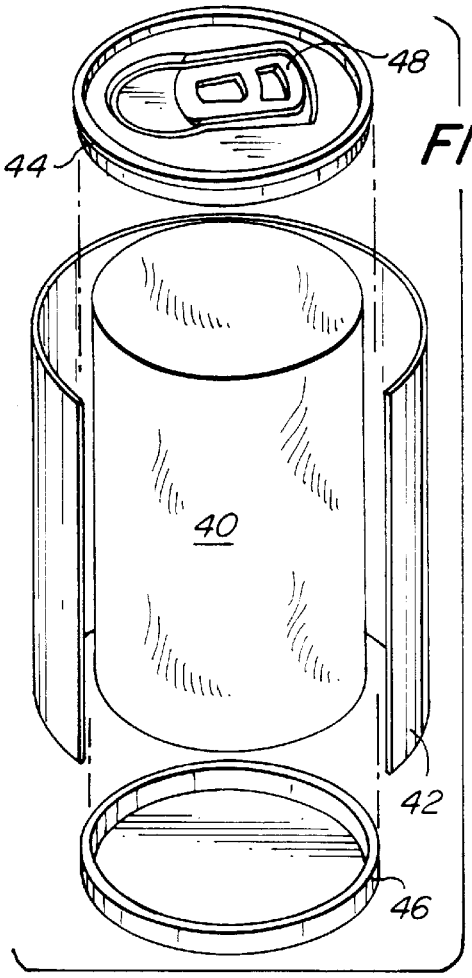
FIG. 4 is an exploded view prior to assembly of a promotional package simulating a beverage can.

FIGS. 4–7 show variants of the promotional package shown in FIGS. 2 and 3. More specifically, FIG. 4 shows a compressed fabric article 40 in the shape of a cylinder with a label 42 and two decorative units 44 and 46. Decorative unit 44 has a simulated opener 48 molded into the plastic to simulate an opener of a beverage can. The shrink wrap that fits over the entire package is not shown in the drawing but is similar to the shrink wrap shown at reference character 20 of FIG. 3. The shrink wrap holds the top 44 and bottom 46 immediately adjacent the compressed fabric article 40 and holds the label 42 in place. Thus, one seeing the promotional package of FIG. 4 would be immediately reminded of a beverage can, and in fact, if the compressed fabric article were made to scale, it would be possible to mistake the promotional package for an actual beverage can. It would even be possible to ship the six (6) t-shirts in one package to simulate a six (6) pack of a particular beverage.

Figure 5:
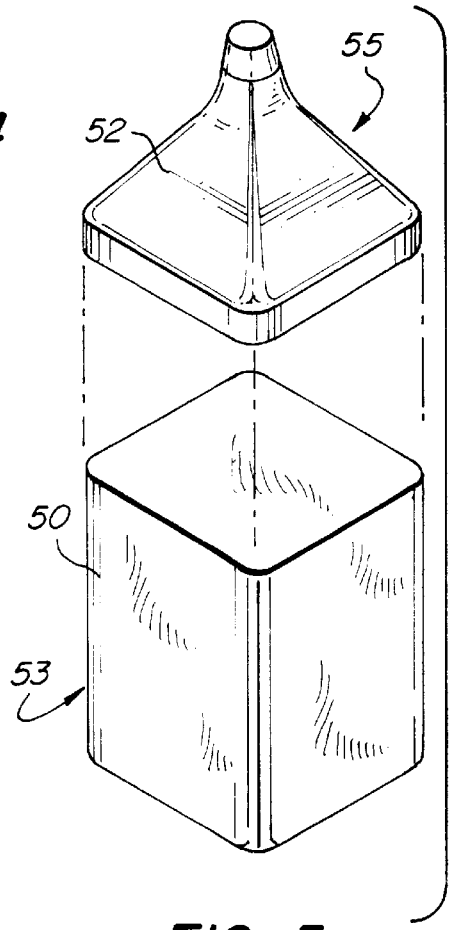
FIG. 5 is an exploded view of a promotional package simulating a bottle having a unique rectangular shape.
Figure 6:
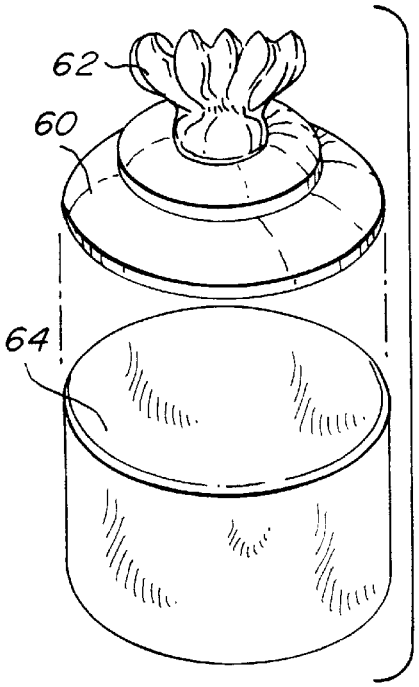
FIG. 6 is an exploded view of another embodiment of a promotional package simulating a product having a distinctive cap.

FIGS. 5 and 6 show the versatility of the concept. More particularly, in FIG. 5, the compressed fabric article 50 has a rectangular shape and is associated with a decorative unit 52 as a complex shape that blends from a rectangular bottom portion 53 to a thin bottle neck 55.

FIG. 6 shows another possibility wherein the decorative unit 60 is very distinctive and could bear the three dimensional logo of a product. More specifically, in perfume bottles, a logo is often presented on the top of a bottle cap. In this case, a decorative unit 60 could be designed to simulate the top of a perfume bottle. Thus, the decorative unit 60 would bear a three dimensional logo 62 and would be assembled onto a compressed fabric article 64.

Figure 7:
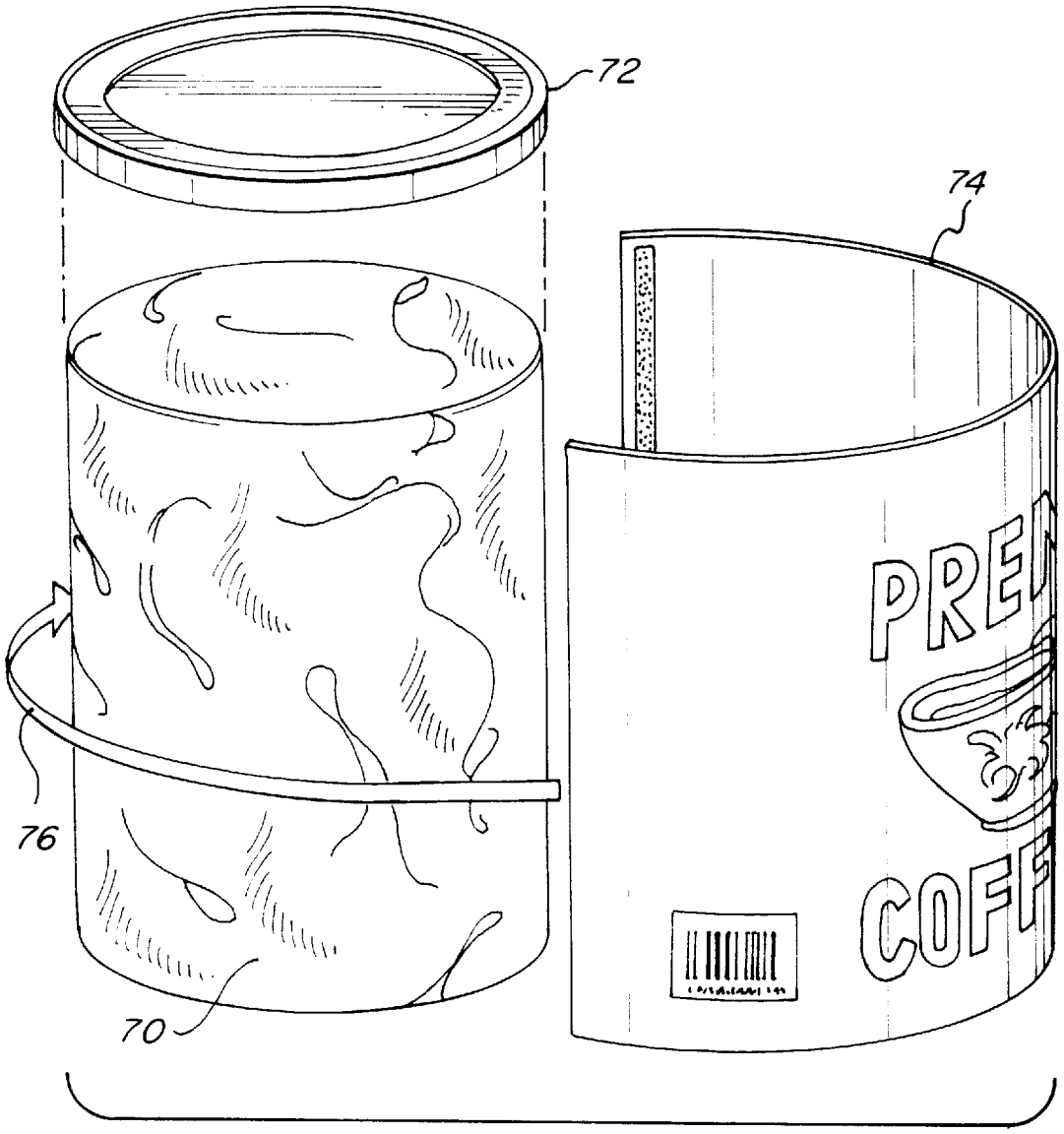
FIG. 7 is an exploded view of another preferred embodiment of a promotional package simulating a can, such as a coffee can, having a re-attachable plastic lid.

FIG. 7 illustrates another preferred embodiment wherein the compressed fabric article 70 has a cylindrical shape and decorative unit 72 comprises a plastic lid having a size and shape to snap onto compressed fabric article 70. Label 74, bearing a coffee brand, is affixed to compressed fabric article 70 in the direction shown by arrow 76. Thus, the compressed fabric article 70, together with the re-usable plastic lid 72 and coffee label 74, combine to resemble a popular coffee can.

The present invention also provides a unique method of assembling the promotional package. As shown in FIGS. 2 and 3, first the fabric article 12 is compressed into a shape simulating one portion of the external contour of the product package, i.e., the bottom portion 23. Then, a label 22 is wrapped around at least a portion of the sidewall of the compressed fabric article 12. The decorative unit 14 is placed adjacent the compressed fabric article 12, and the several parts are retained in position by shrink wrap 20. Thus, in a relatively simple process, a very useful simulated promotional package is provided. A promotional package in accordance with the present invention is particularly useful with package designs that have become distinctive. More specifically, in the case of products such as ABSOLUTE vodka, TANQUERAY gin, and JIM BEAM whiskey, and much of the advertising is directed to the shape of the product. Thus, it is particularly important for the customer and potential customer to not only receive a fabric article such as a t-shirt 10 (FIG. 1) bearing promotional material 12, but also receive it in a shape that is reminiscent of the actual article (FIG. 2). This will enable the manufacturer to build a customer following and promote the distinctive shape of the manufacturer's packaging.

It should be understood that although specific embodiments of the invention have been described herein in detail, such description is for purposes of illustration only and modifications may be made thereto by those skilled in the art within the scope of the invention.

What is claimed is:

1. A promotional package for simulating a product package of the type having a label on the product package and having an external contour, the promotional package comprising:

a bottom portion comprising a fabric article compressed into a shape simulating a portion of the external contour of the product package, the fabric article compressed under substantial pressure so as to be self-supporting and dimensionally stable, the compressed fabric article independently providing substantially all of the shape of the bottom portion of the product package;

at least one decorative unit having a shape simulating another portion of the external contour of the product package, the compressed fabric article being located adjacent the decorative unit; and a flexible retainer maintaining said compressed fabric article adjacent to the decorative unit thereby forming a combined shape simulating the external contour of the product package.

2. A promotional package according to claim 1 wherein the compressed fabric article comprises a body having a continuous sidewall terminating in a planar end portion, the decorative unit having an end in face-to-face relation with the planar end portion, the decorative unit having a sidewall sized to provide a smooth transition with the sidewall of the article body.

3. A promotional package according to claim 2 wherein the sidewall of the compressed fabric article body lies in a series of parallel lines and the decorative unit has a complex curved shape terminating in a unit end, the unit end having a pattern that substantially matches the pattern of the planar end portion of the article body to provide the smooth transition.

4. A promotional package according to claim 3 wherein the decorative unit comprises a hollow body having an opening at one end thereof to form the unit end, the opening being slightly larger than the planar end portion of the compressed fabric article, the article end being inserted through the opening partially into the hollow body.

5. A promotional package according to claim 3 wherein the package further includes a printed sheet positioned adjacent the sidewall of the compressed fabric article, the sheet having an external appearance simulating the product package.

6. A promotional package according to claim 5 wherein the retainer is transparent.

7. A promotional package according to claim 6 wherein the retainer comprises transparent shrink wrap.

8. A promotional package according to claim 6 wherein the product package comprises a beverage bottle having a generally lower portion which transitions into a shoulder and then a bottle neck, the product package having a label bearing indicia, the compressed article shape simulating the lower portion of the beverage bottle and the decorative unit simulating the shoulder and neck of the bottle.

9. A promotional package according to claim 8 wherein the decorative unit opening receives the end portion of the compressed article, the end portion contacting the interior surface of the shoulder, the transparent sheet being wrapped about the shoulder, the printed sheet material and the compressed article to form a promotional package that simulates the beverage bottle.

10. A promotional package according to claim 9 wherein the compressed article bears indicia for promoting the product package.

11. A promotional package according to claim 1 wherein the article comprises a t-shirt.

12. A promotional package according to claim 1 wherein the article has indicia thereon for the purpose of promoting the simulated product package.

13. A promotional package according to claim 1 and further including a second decorative unit placed adjacent the compressed article.

14. A promotional package for simulating a product package having an external contour, the promotional package comprising:

a fabric article compressed under substantial pressure into a shape simulating a portion of the external contour of the product package, the fabric article compressed under sufficient pressure so as to be self-supporting and dimensionally stable such that it independently provides substantially all of the shape of the promotional package at the position of the fabric article, the compressed fabric article having an end;

at least one decorative unit having a shape simulating another portion of the external contour of the product package, the decorative unit having an opening receiving the end of the compressed fabric article;

a sheet of material bearing printed information, the printed sheet positioned adjacent the compressed fabric article; and a flexible sheet of plastic wrapped around the printed sheet, the compressed fabric article and the decorative unit, and maintaining the end of the compressed fabric article inside the opening of the decorative unit and the printed sheet adjacent the compressed fabric article.

* * * * *